US006893012B2

(12) United States Patent
Wong

(10) Patent No.: US 6,893,012 B2
(45) Date of Patent: May 17, 2005

(54) QUICK RELEASE CANTILEVER CLAMP

(75) Inventor: Harry Wong, South Pasadena, CA (US)

(73) Assignee: Valtra, Inc., Pico Rivera, CA (US)

( * ) Notice: Subject to any disclaimer, the term of this patent is extended or adjusted under 35 U.S.C. 154(b) by 59 days.

(21) Appl. No.: 10/444,144

(22) Filed: May 23, 2003

(65) Prior Publication Data

US 2004/0232608 A1 Nov. 25, 2004

(51) Int. Cl.[7] ..... B25B 1/10

(52) U.S. Cl. ..... 269/249; 269/182; 269/239; 269/258; 269/268

(58) Field of Search ..... 269/182, 249, 269/239, 256, 258, 257, 268

(56) References Cited

U.S. PATENT DOCUMENTS 2,671,482 A * 3/1954 Gordon ..... 269/249
2,726,694 A * 12/1955 Saxton ..... 269/239
2,988,122 A * 6/1961 Stevens et al. ..... 269/239
4,245,827 A * 1/1981 Goff et al. ..... 269/239

* cited by examiner

*Primary Examiner*—Robert C. Watson

(57) ABSTRACT

A cantilever clamping device capable of clamping work pieces of variable sizes and shape is equipped with a quick release button at its fixed arm to release the threaded rod and hence the work piece. The Quick Release Cantilever Clamp utilizes a fixed arm and a movable arm with floating pads to clamp the work piece. Clamping action is achieved by turning the threaded rod, one end of which is connected to the movable arm and the other end is attached with a turning handle. Both the fixed arm and the movable arm are designed to have clamping teeth on the curved inner edges to clamp large size cylindrical work pieces and the floating pads are for smaller size cylindrical work pieces and work pieces of different shape and sizes. The fixed arm is equipped with two holes for attaching the optional base block to mount the clamp on a work surface.

7 Claims, 5 Drawing Sheets

QUICK RELEASE CANTILEVER CLAMP

BACKGROUND OF THE INVENTION

1. Field of the Invention

The present invention relates to a cantilever clamping device comprises a fixed arm, a movable arm and a threaded rod to control the clamping and release of the work piece. One end of the movable arm is pivoted to the middle of the fixed arm. In the middle of the movable arm, one end of the threaded rod is pivoted. The threaded rod is fed through a cylindrical block pivoted to one end of the fixed arm and equipped with a spring-loaded quick release mechanism. The threaded rod can be moved in or out either slowly by turning the handle at the outside end or quickly by pressing the spring-loaded quick release button. The quick release button can be placed along the axis of the cylindrical block or on the side of it. The inner edges of the fixed arm and the movable arm are designed to be curved in shape and have clamping teeth for clamping larger size cylindrical work piece such as large pipes, column and filter cartridges, etc. The fixed arm and the movable arm can be one-piece or two-piece construction. Two floating pads are pivoted to the free end of the fixed arm and the movable arm respectively. The clamping surfaces of the floating pads are designed with different features, round cavity with teeth on the surface of the floating pad pivoted to the fixed arm and V-notches on the surface of the floating pad pivoted to the movable arm, so that work pieces of variable sizes and shape can be clamped between the floating pads easily and firmly. The shape at the end of the fixed and movable arms limits the pivoting angle of the pads to make the pads oriented to the work piece. Both floating pads are equipped with two holes for attaching accessories or pads of different sizes and unique design to accommodate different kind of work pieces. To further enhance the function of the invention, an optional base block can be mounted to the fixed arm with screws through the holes on the fixed arm so that the clamping device can be mounted on a work bench, wooden stud, desk top, wall, or the like.

2. Description of the Related Art

A conventional cantilever clamp utilizes the mechanism of threaded rod, fixed arm, movable arm and clamping heads is capable of clamping work pieces of flat surfaces, or with special attachment to the clamping head for special type of application. To clamp work pieces of different shape and different sizes, several clamping devices with special clamping head or clamping head attachment will be required to do the job properly. The clamping and release action of a conventional clamping device would require the turning of the threaded rod turn by turn and hence moving the movable arm pitch by pitch in either direction. It is the intention of the present invention to eliminate the time consuming work of the pitch by pitch movement by utilizing a quick release button with spring-loaded quick release mechanism in the cylindrical block through which the threaded rod is fed. Further intention of the present invention is to combine variable clamping features in one device so that work pieces of different shape and sizes can be clamped without changing the clamping device or the clamping heads. Another intention of the invention is to make the clamping device more adaptable to different applications by adding two holes on the fixed arm to attach the optional base block. Hence the clamping device can be used freely by itself or fixed on a work bench.

SUMMARY OF THE INVENTION

The present invention comprises a fixed arm with a floating pad, a movable arm with a floating pad, a threaded rod with turning handle, a spring-loaded quick release mechanism and an optional base block. Both the fixed arm and movable arm can be one-piece or two-piece design. The descriptions hereinafter refer to the two-piece design. However, the special features and advantages of the present invention described below will apply to both the one-piece and two-piece designs without exception. Furthermore, the features and advantages will not be limited by the physical size of the clamping device.

The fixed arm is made of two identical "J" shape metal plates welded or riveted together with spacers in between. To the curved end of the fixed arm, a floating pad is pivoted. The angle of rotation is limited by the shape of the end of the fixed arm to make the floating pad oriented to the work piece. To the other end of the fixed arm, a cylindrical block is pivoted. The cylindrical block is used to feed the threaded rod for controlling the clamping device.

The movable arm is made of two identical shorter "J" shape metal plates welded or riveted together with spacers in between. To the curved end of the movable arm, a floating pad is pivoted. The angle of rotation is limited by the shape of the end of the movable arm to make the floating pad oriented to the work piece. The other end of the movable arm is pivoted freely to the middle of the fixed arm so that its inner curved edges is facing the inner curved edges of the fixed arm. One end of the threaded rod is attached through a floating block pivoted to the middle of the movable arm. This will allow the control of the angular motion of the movable arm by turning the threaded rod so that the work piece can be clamped or released by the clamping device.

The inner curved edges of both the fixed arm and the movable arm are equipped with clamping teeth to clamp larger diameter cylindrical work pieces such as large pipes, column and filter cartridges, etc. This unique feature of the invention enables the tight and proper clamping of large diameter work piece for various applications.

Another feature of the invention is the spring loaded quick release mechanism built into the cylindrical block through which the threaded rod is fed. This quick release mechanism comprises a sliding half-nut, a compressed spring inside the cylindrical block, and a quick release button outside. The compressed spring is mounted between the half-nut and the inside of the cylindrical block. The hole of the half-nut is half-threaded on the side closer to the spring. The half-nut is thus spring-loaded with its thread pressed against the threaded rod. The position of the half-nut inside the cylindrical block is controlled by the quick release button. When the quick release button is pressed, the half-thread of the spring-loaded half-nut is disengaged from the threaded rod so that the threaded rod and hence the movable arm can be moved in or out quickly and freely. When the quick release button is released, the half-thread of the half-nut is forced to engage on the threaded rod with certain amount of pressure by the loaded spring. It is in such a position that the movable arm can be moved pitch by pitch with the turning of the threaded rod. The quick release mechanism can be mounted either laterally along the axis of the cylindrical block or on the outer side of the cylindrical block perpendicular to the axis of the block. This corresponds to the two versions of design of the quick release cantilever clamp. The description below refers to the laterally mounted version.

The surface of the floating pad pivoted to the fixed arm is designed to have round cavity with clamping teeth. It is the intention of this design to provide a perfect means to clamp cylindrical work pieces of medium size. The surface of the floating pad pivoted to the movable arm is designed to have two V-notches forming a cross on the surface. The intention of this design is to clamp work pieces with angles, or square edges, etc. To expand the function of the invention further, two holes are provided on each of the floating pads for the attachment of accessories or pads of different sizes and unique design so that various sizes and shape of work pieces can be clamped with the invention.

The outer end of the threaded rod is equipped with a turning handle. By turning this handle clockwise or counterclockwise, the movable arm is moved towards or away from the work piece pitch by pitch to achieve the clamping or release action. The clamping force on the work piece can be adjusted with the same action. With the quick release button pressed while pushing or pulling the turning handle, the movable arm can be moved in or out quickly to clamp or release the work piece. This also provides a quick and easy way to set up the quick release cantilever clamp at the proper orientation for a particular work piece.

Four holes are equipped near the outer curved edges of the fixed arm to mount the optional base block. The base block is rectangular in shape with a rectangular protrusion in the middle. Two screw holes are provided on the sides of the protrusion for mounting the cantilever clamp. On the base area of the base block, two elongated notches are equipped at both ends for screws to attach the cantilever clamp on a work bench, wooden stud, desk top, wall, or the like.

DETAILED DESCRIPTION OF THE INVENTION

With the help of the drawings and the detail description below, the features of the present invention will be apparent and fully understandable.

Figure 1:
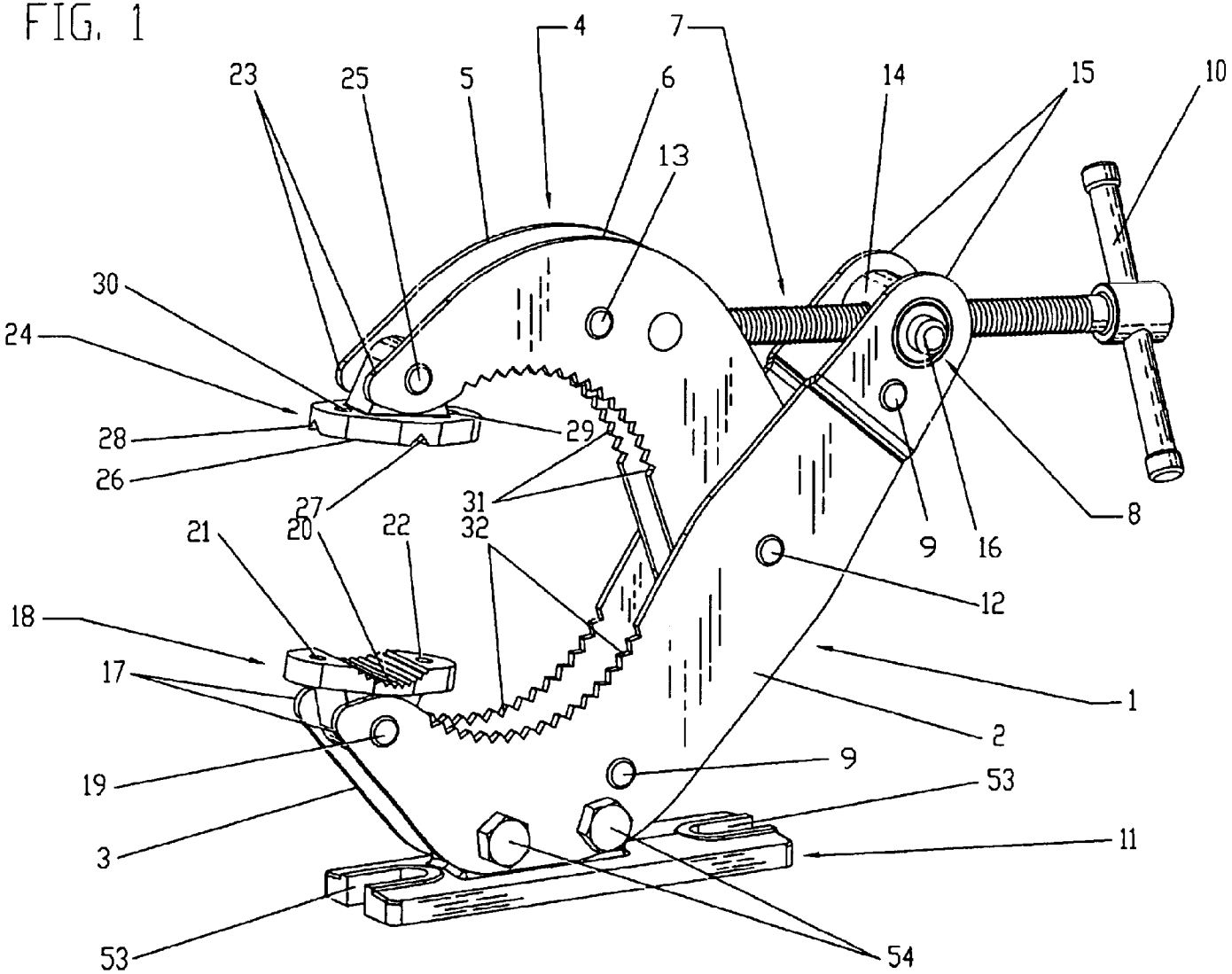
FIG. 1 is a perspective view of the Quick Release Cantilever Clamp with the optional base block attached.
Figure 2:
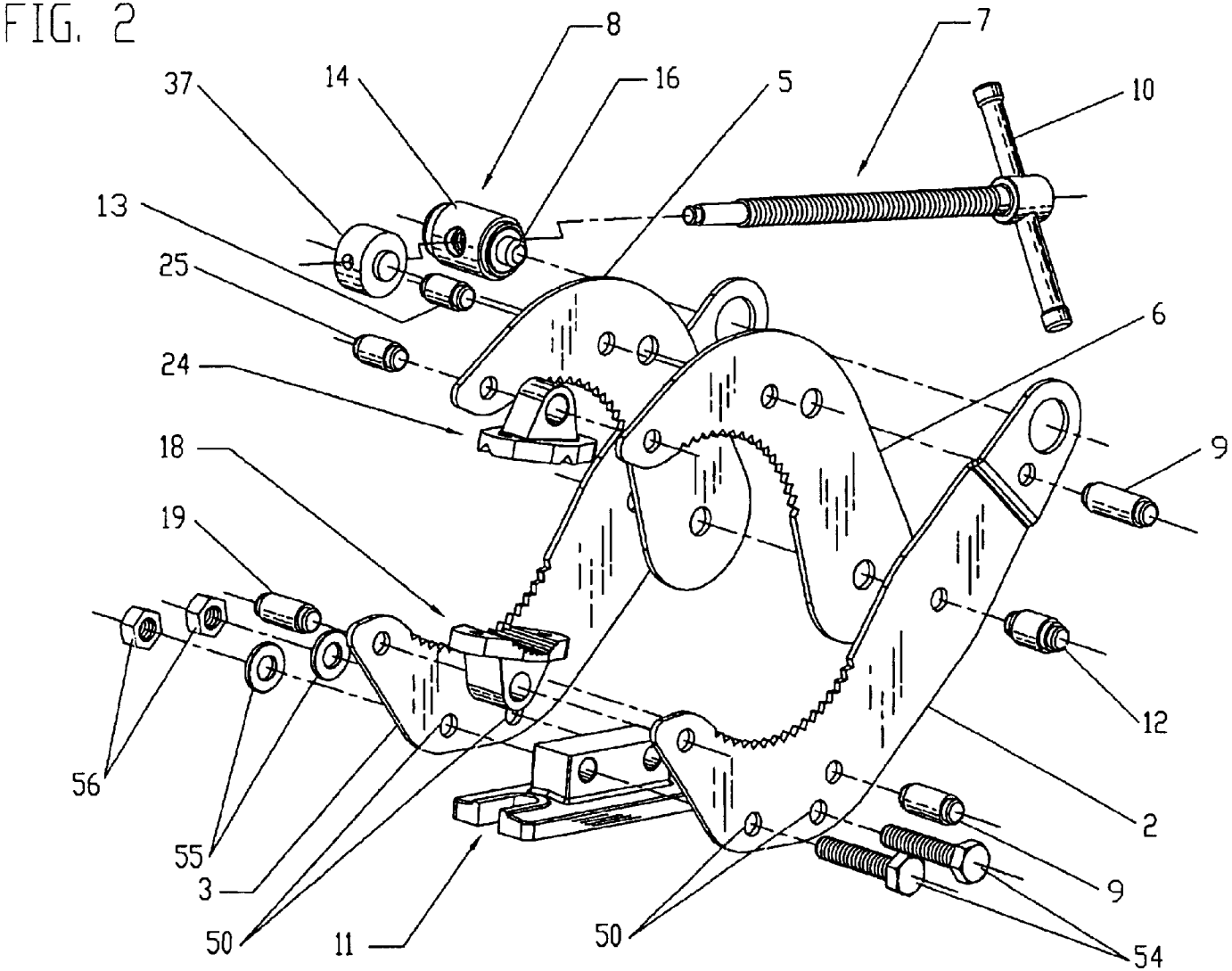
FIG. 2 is an exploded view of the Quick Release Cantilever Clamp.

Referring to FIG. 1 and FIG. 2, the Quick Release Cantilever Clamp comprises a fixed arm 1 which is made up of two "J" shape metal plates 2 and 3 welded or riveted together with spacers 9 in between to provide the effective thickness of the arm assembly; a movable arm 4 which is made up of two "J" shape metal plates 5 and 6 welded or riveted together with spacer 13 in between to provide the effective thickness of the arm so that the movable arm 4 can be fitted into the fixed arm 1; and a threaded rod 7 with quick release mechanism 8 and turning handle 10. An optional base block 11 may be added to mount the cantilever clamp to a work bench.

With reference to FIG. 1 and FIG. 2, the movable arm 4 is pivoted to the middle of the fixed arm 1 with pivot 12 so that the inner curved edges of the movable arm 4 is facing the inner curved edges of the fixed arm 1. One end of the threaded rod 7 is pivoted to a floating block 37 which is pivoted to the middle of the movable arm 4. The threaded rod 7 is fed through a cylindrical block 14 which is pivoted at the straight end 15 of the fixed arm 1. The cylindrical block 14 is part of the quick release mechanism 8 and attached to the quick release button 16.

Figure 5:
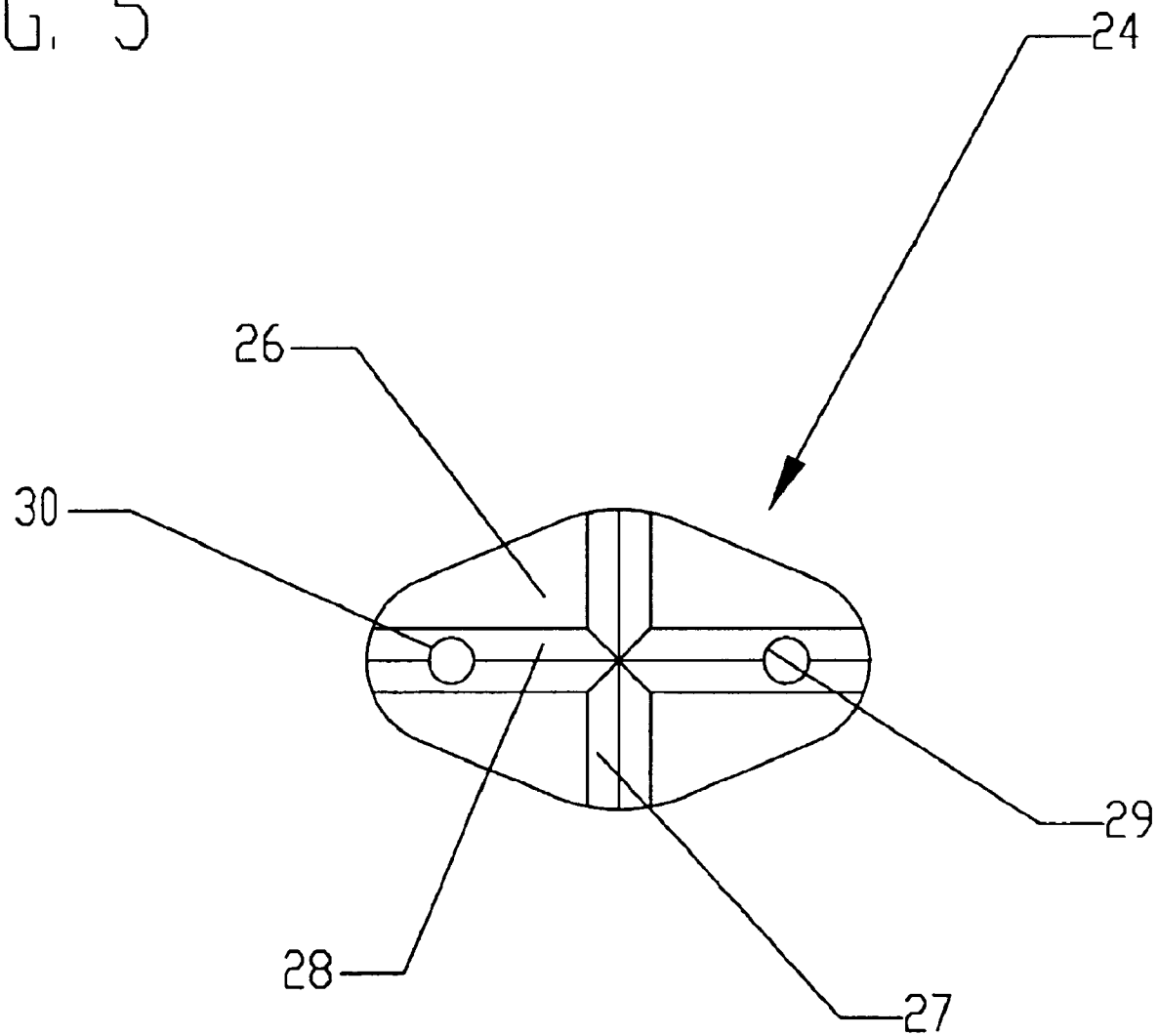
FIG. 5 is a bottom view of the floating pad attached to the movable arm.

Still referring to FIG. 1 and FIG. 2, to the curved end 17 of the fixed arm 1, a floating pad 18 is pivoted with pivot 19. The shape of end 17 is made so that the pivoting angle of the pad 18 is limited to make the clamping surface 20 oriented to the work piece. The clamping surface 20 of pad 18 is made to be round cavity with clamping teeth. This design is used to clamp small to medium size cylindrical work pieces. Two holes 21 and 22 are equipped at both ends of the floating pad 18 for attaching by screws accessories or special design pads of different sizes with unique features for various applications. To the curved end 23 of the movable arm 4, another floating pad 24 is pivoted with pivot 25. The shape of end 23 is machined so that the pivoting angle of the pad 24 is limited to make the clamping surface 26 oriented to the work piece. The clamping surface 26 of pad 24 is made to have two crossed V-notches 27 and 28 as shown on FIG. 5. These notches 27 and 28 are convenient when clamping work pieces with straight edges, square angles, etc. Two holes 29 and 30 are equipped at both ends of the floating pad 24 for attaching by screws accessories or special design pads of different sizes with unique features for various applications.

The inner curved edges of both the movable arm and fixed arm are made to have clamping teeth 31 and 32. This design is used to clamp large diameter cylindrical work piece, such as, large pipes, column and filter cartridges, etc.

Figure 3:
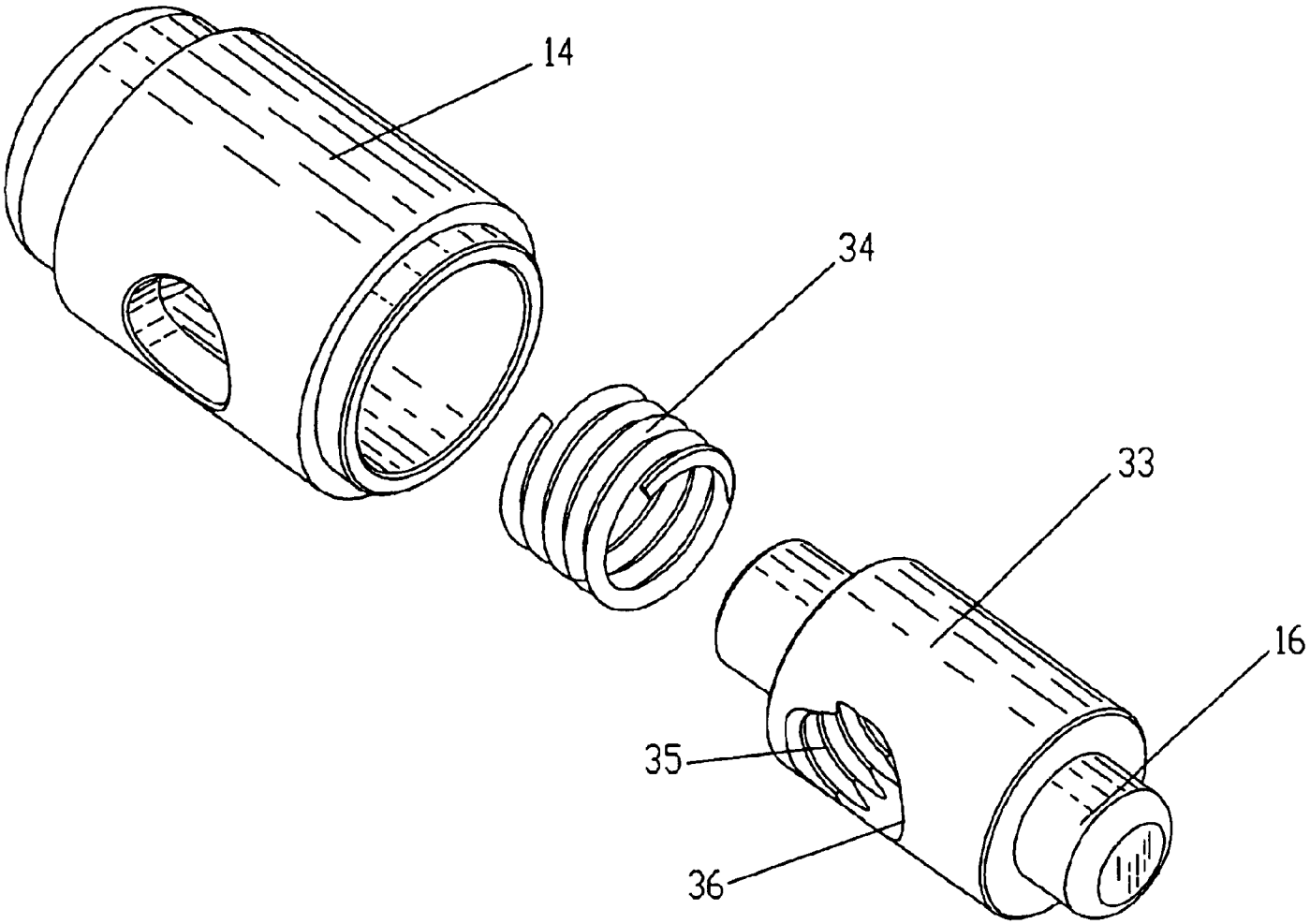
FIG. 3 is an exploded view of the spring-loaded quick release mechanism.

Referring to FIG. 1 and FIG. 3, the quick release mechanism 8 mounted at the straight end 15 of the fixed arm 1 includes a cylindrical block 14, quick release button 16 with half-nut 33 and spring 34. The half-nut 33 is cylindrical in shape and fitted inside the cylindrical block 14 so that it is free to slide within block 14. One hole 36 is drilled to the center of the half-nut 33 and perpendicular to the axis of it. The hole 36 is half-threaded 35 on the side closer to the spring 34. One end of half-nut 33 is attached to the quick release button 16 and the other end is pressed against the spring 34. Spring 34 is thus compressed against the inner wall of cylindrical block 14 so that a suitable amount of force is exerted by the threaded surface 35 of half-nut 33 on the threaded rod 7. In this position, the movable arm 4 can be moved in or out pitch by pitch by turning the threaded rod 7 clockwise or counterclockwise. When the quick release button 16 is pressed inward so that threaded surface 35 of half-nut 33 is moved away from the threaded rod 7, then the threaded rod 7 is free to move laterally through the hole 36. As a result, the movable arm 4 can be moved quickly in or out by pushing or pulling the threaded rod 7.

Figure 4:
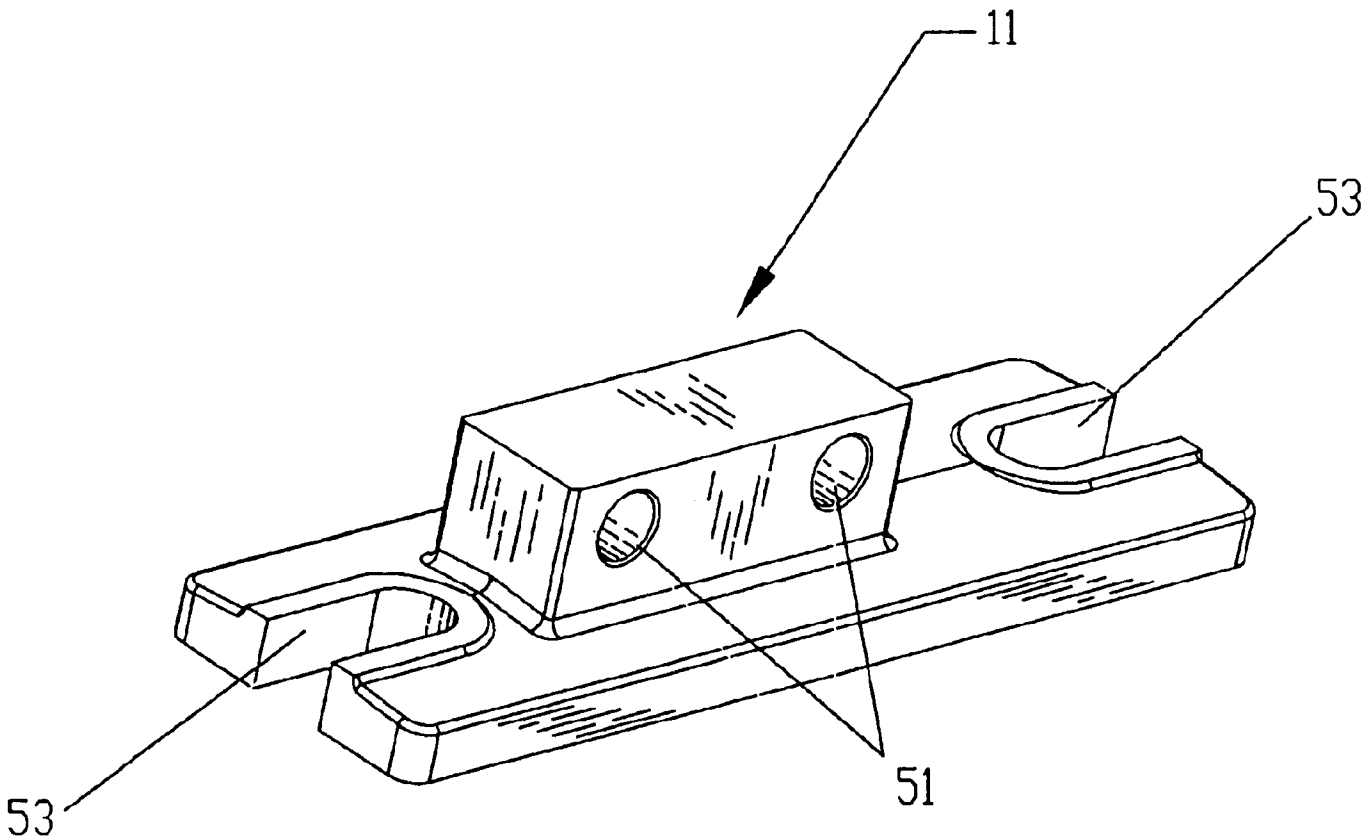
FIG. 4 is a perspective view of the base block.

Referring to FIG. 2 and FIG. 4, two holes 50 are made to the outer curved edges of both metal plates 2 and 3 of the fixed arm 1. These holes are used to attach the optional base block 11 with two sets of screws 54, washers 55 and nuts 56. The base block 11 is rectangular in shape with a rectangular protrusion in the middle. Two screw holes 51 are machined on the longer side of the protrusion for the screws 54 to mount the fixed arm 1. On each end of the rectangular base of the base block 11, two elongated notches 53 are equipped. These notches are used to mount the base block with the quick release cantilever clamp assembly on a work bench, wooden stud, desk top, wall, or the like.

What I claim as my invention is:

1. A quick release cantilever clamp comprising:

a "J" shape fixed arm having a straight portion and a curve portion;

a shorter "J" shape movable arm having a shorter straight portion and a curve portion, said movable arm being reversely pivoted with said shorter straight portion to the middle of said fixed arm so that the concave edges of said curve portion of said movable arm is facing the concave edges of said curve portion of said fixed arm;

a spring loaded quick release mechanism pivoted to the end of said straight portion of said fixed arm;

a threaded rod with a turning handle at one end, being fed through said quick release mechanism and pivoted to the middle of said movable arm at the other end;

a first floating pad pivoted to the end of said curve portion of said fixed arm;

a second floating pad pivoted to the end of said curve portion of said movable arm;

a base block adapted to being mounted to the convex edge of said curve portion of said fixed arm so that the clamp can be fixed on a table, work bench or the like.

2. The quick release cantilever clamp according to claim 1, wherein said fixed arm comprises two identical "J" shape metal plates riveted together in parallel with spacers in between;

said movable arm comprises two shorter "J" shape metal plates riveted together in parallel with spacers in between.

3. The quick release cantilever clamp according to claim 1, wherein said concave edges of said curve portion of said fixed arm are equipped with clamping teeth;

said concave edges of said curve portion of said movable arm are equipped with clamping teeth.

4. The quick release cantilever clamp according to claim 1, wherein said first floating pad consisting a first clamping surface concave in shape with clamping teeth, one hole at each end to attach clamping pads with other surface features;

said second floating pad consisting a second damning surface with two V-notches forming a cross, and one hole at each end to attach clamping pads with other surface features;

the angle of rotation of said first floating pad being limited by the shape of the end of said curve portion of said fixed arm to orient said first clamping surface towards a work piece to be clamped;

the angle of rotation of said second floating pad being limited by the shape of the end of said curve portion of said movable arm to orient said second clamping surface towards said work niece to be clamped.

5. The quick release cantilever damn according to claim 1, wherein said spring loaded quick release mechanism comprising a cylindrical block, a sliding half-nut, a compressed spring between said sliding half-nut and the internal wall of said cylindrical block, and a quick release button;

a half-threaded hole being cut through said sliding half-nut perpendicular to the axis of said sliding half-nut;

said quick release button being attached to one end of said sliding half-nut opposite to the end touching said compressed spring.

6. The quick release cantilever clamp according to claim 5, wherein said threaded rod is fed through said half-threaded hole of said sliding half-nut;

one end of said threaded rod being pivoted to the middle of said movable arm through a metal block;

the other end of said threaded rod being attached with a turning handle for turning said threaded rod to close or open said first floating pad to clamp or release a work piece.

7. The quick release cantilever damn according to claim 1, wherein two holes are made on said curve portion of said fixed arm for attaching said base block with two sets of screw, washer and nut;

said base block is rectangular in shape with a smaller rectangular protrusion in the middle, two holes are made on said protrusion for attaching to said fixed arm, and two elongated notches are made on said base block, one at each end.

* * * * *